US011432599B2

(12) United States Patent
Lee

(10) Patent No.: US 11,432,599 B2
(45) Date of Patent: Sep. 6, 2022

(54) FINGER GUARD

(71) Applicant: Jongyoung Lee, Seoul (KR)

(72) Inventor: Jongyoung Lee, Seoul (KR)

( * ) Notice: Subject to any disclaimer, the term of this patent is extended or adjusted under 35 U.S.C. 154(b) by 0 days.

(21) Appl. No.: 16/737,887

(22) Filed: Jan. 8, 2020

(65) Prior Publication Data

US 2021/0120892 A1 Apr. 29, 2021

(51) Int. Cl.
*A41D 13/08* (2006.01)

(52) U.S. Cl.
CPC ..... *A41D 13/087* (2013.01)

(58) Field of Classification Search
CPC ..... A41D 13/087; A41D 19/01505; A41D 19/01511; A41D 19/01517; A61B 42/20; F41H 5/1476; F41H 5/02; F41H 5/026; F41H 5/0492
USPC ..... 2/21
See application file for complete search history.

(56) References Cited

U.S. PATENT DOCUMENTS 580,752 A * 4/1897 Bailey ..... A47J 17/02 30/123.5
1,036,017 A * 8/1912 Skaggs ..... A41D 13/087 2/21
1,074,757 A * 10/1913 Thomas ..... A41D 13/087 2/21
1,123,630 A * 1/1915 Waller ..... A41D 13/087 2/21
1,174,887 A * 3/1916 Meriwether ..... A61F 13/105 294/25

(Continued)

FOREIGN PATENT DOCUMENTS

DE 102006040544 B3 * 2/2008 ..... A63B 71/148
KR 10-0705351 B1 4/2007

(Continued)

*Primary Examiner* — Heather Mangine
*Assistant Examiner* — Raquel M. Weis
(74) *Attorney, Agent, or Firm* — Patent Office of Dr. Chung Park

(57) ABSTRACT

Disclosed is a finger guard. In an example embodiment, the finger guard includes a rectangular reticulate or netlike pad networked in a movable manner such that a plurality of unit plate pieces are connected to one another in four directions by a plurality of connecting loop members, and at least a pair of fastening belt members provided to extend or protrude parallel with one side of the reticulate pad, wherein the finger guard is configured to be worn in the form of a protective armor such that the reticulate pad covers and wraps around the dorsal side of a finger, upon which the finger guard is to be worn, and the respective fastening belt members pass the volar side of the finger to then be connected to be hooked on to one of the unit plate pieces in a state in which a portion of the volar side of the finger is opened and exposed in a length direction of the finger. With this configuration, the finger guard of the present disclosure is configured to be worn in the form of a protective armor such that fastening of the finger guard can be appropriately adjusted so as to be tailored to the thickness of a wearer's finger when the finger guard is worn for finger protection, thereby achieving enhanced functionality and quality for efficiently performing an elaborate and precise work by improving convenience in use and wearing comfort.

4 Claims, 3 Drawing Sheets

(56) References Cited

U.S. PATENT DOCUMENTS 1,268,103 A * 6/1918 Fleming ..... A41D 13/087 2/21
1,294,191 A * 2/1919 Suderlock ..... F41H 1/02 160/135
1,314,096 A * 8/1919 Ross ..... A61F 13/105 294/25
1,388,618 A * 8/1921 Stein ..... A41D 19/01517 2/21
1,516,385 A * 11/1924 Keck ..... A41D 13/087 2/21
1,546,346 A * 7/1925 Mandalian ..... A44C 27/00 245/9
1,736,928 A * 11/1929 Lowe ..... A41D 19/01511 2/167
1,817,519 A * 8/1931 Mandalian ..... A45C 13/083 428/52
1,951,190 A * 3/1934 Gambee ..... D05B 91/04 2/21
2,039,505 A * 5/1936 Vollmer ..... A41D 13/087 2/21
2,139,512 A * 12/1938 Nagorny ..... A44C 15/00 63/37
2,373,726 A * 4/1945 Watts ..... F41H 5/02 160/220
2,404,846 A * 7/1946 Kalisher ..... A45C 13/083 428/52
2,871,556 A * 2/1959 Chisholm ..... B21D 47/00 29/513
3,746,602 A * 7/1973 Caroli et al. ..... A47H 23/10 428/52
4,089,066 A * 5/1978 Dethman ..... A45D 29/00 2/21
4,167,044 A * 9/1979 Girard ..... A61F 2/72 602/20
4,229,496 A * 10/1980 Striegel ..... A45C 13/08 428/33
4,272,849 A * 6/1981 Thurston ..... A41D 19/01517 2/16
4,442,150 A * 4/1984 Greiner ..... B65G 17/08 428/53
4,507,804 A * 4/1985 Consigny ..... A41D 13/087 2/163
4,719,906 A * 1/1988 DeProspero ..... A61F 5/013 602/21
4,727,862 A * 3/1988 Waddell ..... A61F 5/02 602/16
4,843,650 A * 7/1989 Kangas ..... A41D 19/01511 2/16
4,905,681 A * 3/1990 Glascock ..... A61F 15/008 128/846
5,031,608 A * 7/1991 Weinstein ..... A61F 13/105 602/22
5,515,541 A * 5/1996 Sacks ..... F41H 5/023 2/2.5
5,609,165 A * 3/1997 Lambert ..... A61B 42/00 128/880
5,853,863 A * 12/1998 Kim ..... A41D 31/245 428/223
5,906,873 A * 5/1999 Kim ..... A41D 31/245 428/57
6,032,290 A * 3/2000 Lucas ..... A41D 19/00 2/159
6,058,503 A * 5/2000 Williams ..... A41D 13/06 2/16
6,159,590 A * 12/2000 Kim ..... A61B 42/00 428/223
6,189,157 B1 * 2/2001 Ziegler ..... F41H 5/0492 2/455
6,557,177 B2 * 5/2003 Hochmuth ..... A41D 19/015 2/159
6,842,908 B1 * 1/2005 Saito ..... F41H 5/0492 2/2.5
6,925,653 B1 * 8/2005 King ..... A41D 13/087 2/163
7,143,447 B2 * 12/2006 Fleischmann ..... A41D 13/087 2/16
7,527,845 B2 * 5/2009 King ..... B32B 7/08 428/53
7,574,748 B2 * 8/2009 Fisher ..... A41D 19/01588 2/16
7,802,315 B2 * 9/2010 Contant ..... A63B 71/143 2/161.1
7,958,568 B2 * 6/2011 Fisher ..... A63B 71/148 2/16
7,972,549 B2 * 7/2011 O'Connor ..... B29C 66/12421 264/263
8,028,347 B2 * 10/2011 Chang ..... A41D 19/01588 2/161.1
8,341,763 B2 * 1/2013 Geyer ..... A63B 71/148 2/21
8,516,612 B2 * 8/2013 Lynn ..... A41D 13/087 2/21
9,801,439 B2 * 10/2017 Nie ..... A45C 3/001
10,905,181 B2 * 2/2021 Rabbeth, Jr. ..... A41D 19/01588
2002/0073477 A1 * 6/2002 Hochmuth ..... A41D 19/01588 2/161.1
2004/0025223 A1 * 2/2004 Jaunault ..... A41F 1/06 2/159
2005/0251078 A1 * 11/2005 Fleischmann ..... A41D 13/087 602/22
2006/0048259 A1 * 3/2006 Keppler ..... A41D 19/01588 2/21
2009/0222967 A1 * 9/2009 Winningham ..... A41D 13/05 2/21
2009/0307821 A1 * 12/2009 Chang ..... A63B 71/148 2/21
2012/0144545 A1 * 6/2012 Lynn ..... A41D 13/087 2/21
2016/0146579 A1 * 5/2016 Alaniz ..... F41H 5/02 89/36.02
2018/0317578 A1 * 11/2018 Furukawa ..... A41D 19/0089
2018/0368491 A1 * 12/2018 Anunike ..... A41D 13/087

FOREIGN PATENT DOCUMENTS

KR 20-0461721 Y1 8/2012
KR 10-1330005 B1 11/2013
KR 10-2013-0135689 A 12/2013
KR 20130135689 A * 12/2013
KR 10-2014-0008148 A 1/2014
KR 20140008148 A * 1/2014
KR 20-0476537 Y1 3/2015
KR 20-0476538 Y1 3/2015
KR 476538 Y1 * 3/2015
KR 200476538 Y1 * 3/2015
KR 10-1563621 B1 10/2015
KR 10-1852157 B1 4/2018

* cited by examiner

[FIG. 1]
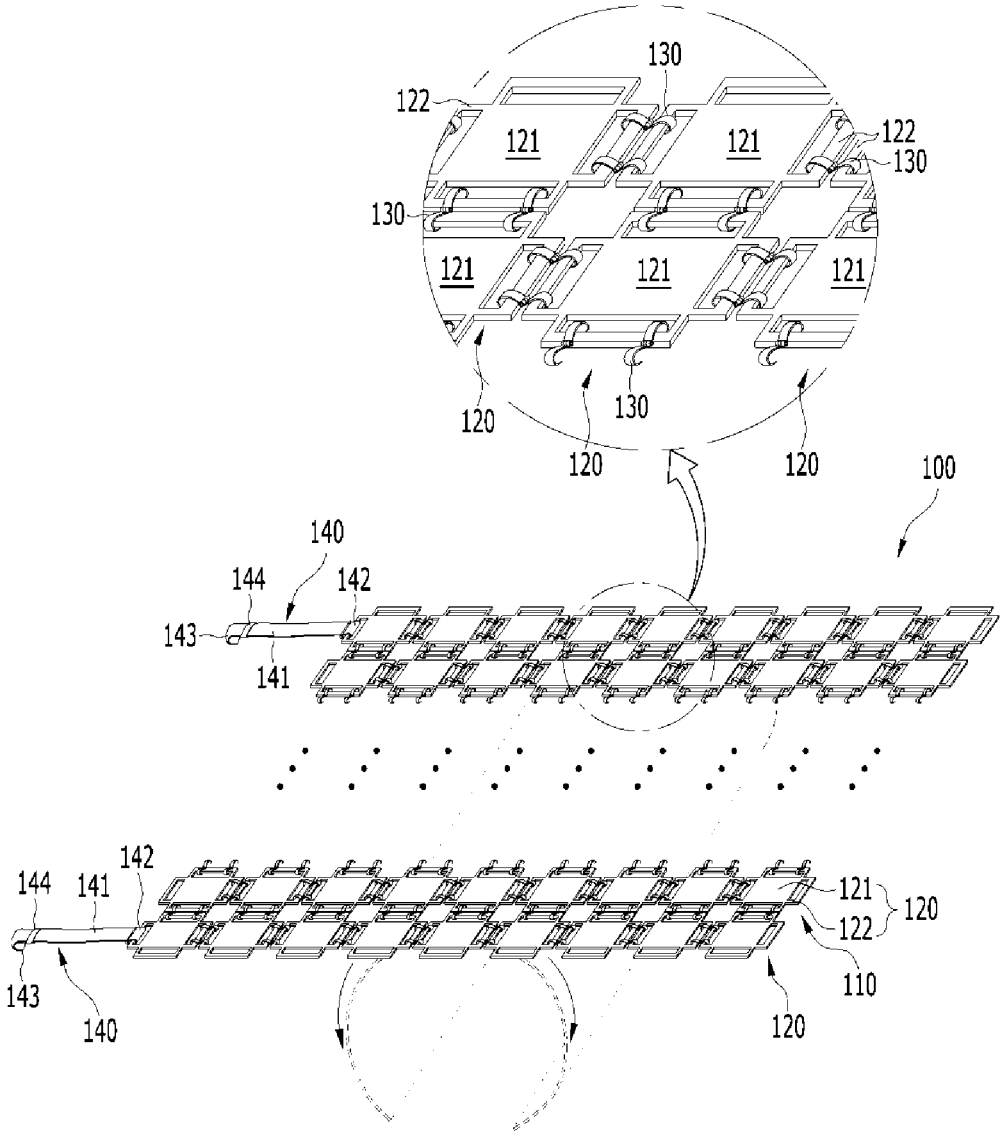

[FIG. 2]
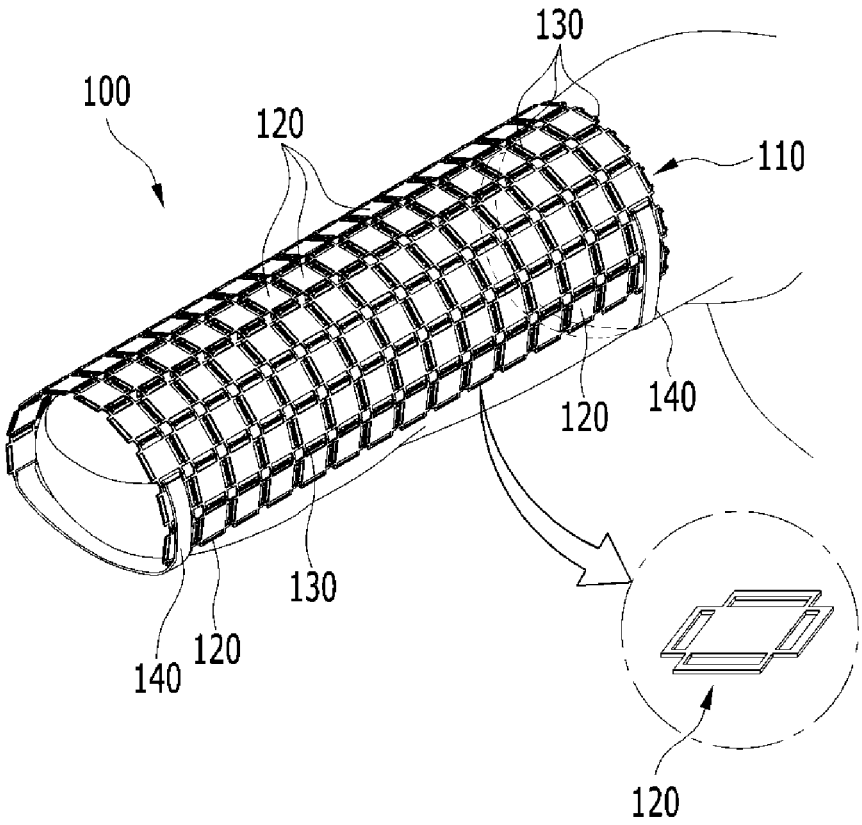
[FIG. 3]
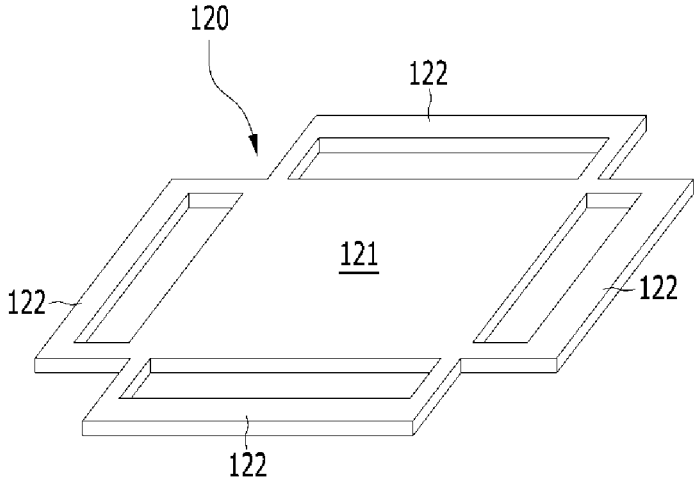

[FIG. 4]
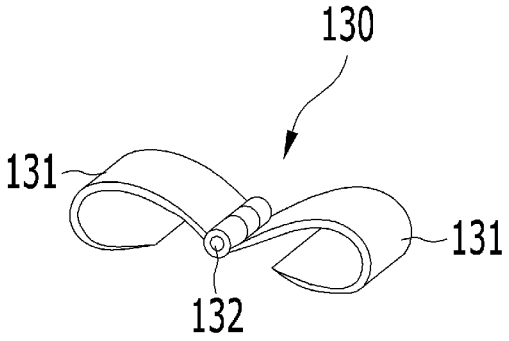
[FIG. 5]
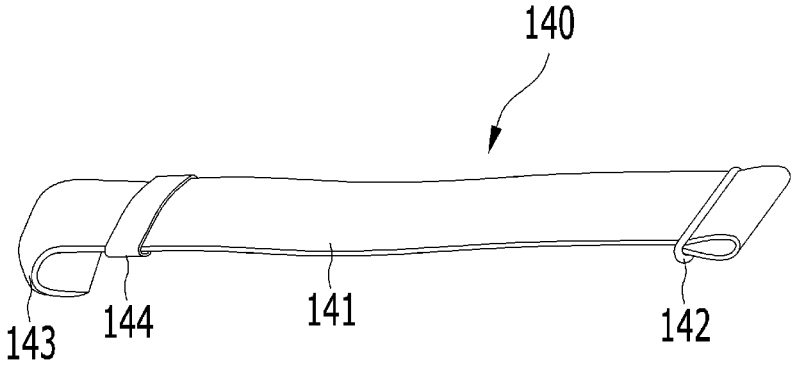

FINGER GUARD

CROSS-REFERENCE TO RELATED APPLICATION

This application claims priority to and the benefit of Korean Patent Application No. 10-2019-0135133 filed on Oct. 29, 2019 in the Korean Intellectual Property Office, the contents of which in its entirety are herein incorporated by reference.

BACKGROUND

1. Field

The present disclosure relates to a finger guard, and particularly to a finger guard for protecting a wearer's finger against injury due to accidental finger cuts caused when slicing or cutting foodstuff using a cutting tool, such as a culinary knife. More particularly, the present disclosure relates to a finger guard, which can be worn in an adjustably fastened condition according to the thickness of a wearer's finger by permitting the finger guard to be worn in the form of, for example, a protective armor, and can efficiently improve flexibility and a degree of freedom in terms of finger motions and knuckle movements so as to facilitate bending or flexion of the wearer's finger.

2. Description of the Related Art

When cutting for cooking, scissoring a pad material, or handling a cutting tool, such as a sharp edged tool, there are constant concerns about severe or minor injury to a worker's finger due to cuts or punctures.

To address such concerns in doing works using the cutting tool, like in a cutting work using a knife or a scissoring work, several types of finger guards have been proposed, including Korean Patent Registration No. 10-1330005, Korean Utility Model Registration No. 20-0476537 and 20-0476538, and so on.

However, the existing finger guards are typically configured to be worn in a wearing position in which a wearer's finger is inserted into a hollow portion of a pipe-shaped (or tubular) body of a finger guard and then accommodated in the body. With this configuration, when a wearer moves his or her finger in a state in which the wearer's finger is inserted into the inflexible or inelastic pipe-shaped (or tubular) body, a degree of freedom in terms of finger motions may be noticeably lowered.

Therefore, since it is quite difficult to perform knuckle movements in a wearing position of the existing finger guard, efficiently performing an elaborate and precise work may be difficult to achieve.

In addition, because there is no fastening means for fastening opposite ends of a finger, upon which the finger guard is to be worn, the existing finger guard may become gradually loosened due to repetition of wearer's finger motions, resulting in inconvenience in use and lowering stability.

The present disclosure has been derived under these technical backgrounds stated above, and information about the problems posed in the background art had been held by the applicant of the preset disclosure for the purpose of deriving the present disclosure or had been acquired in the course of deriving the present disclosure. Accordingly, the above information cannot be necessarily considered as the content known to the general public prior to filing of the present disclosure.

SUMMARY

The present invention has been made in an effort to solve the problems of the prior art finger guard, and it is an object of the present invention to provide a finger guard having improved stability, practicability and wearing comfort by permitting the finger guard to be worn in the form of a protective armor such that fastening of the finger guard can be appropriately adjusted so as to be tailored to the thickness of a wearer's finger when the finger guard is worn for finger protection.

It is another object of the present invention to provide a finger guard having enhanced wearing flexibility and freedom to improve a degree of freedom in terms of finger motions and knuckle movements for facilitating bending or flexion of the finger when the finger guard is worn for finger protection.

It is still another object of the present invention to provide a finger guard exhibiting enhanced functionality and quality for efficiently performing an elaborate and precise work when the finger guard is worn for finger protection.

According to an aspect of the present disclosure, a finger guard includes a rectangular reticulate or netlike pad networked in a movable manner such that a plurality of unit plate pieces are connected to one another in four directions by a plurality of connecting loop members, and at least a pair of fastening belt members provided to extend or protrude parallel with one side of the reticulate pad, wherein the finger guard is configured to be worn in the form of a protective armor such that the reticulate pad covers and wraps around the dorsal side of a finger, upon which the finger guard is to be worn, and the respective fastening belt members pass the volar side of the finger to then be connected to be hooked on to one of the unit plate pieces in a state in which a portion of the volar side of the finger is opened and exposed in a length direction of the finger.

In some examples of the finger guard having aforementioned configuration, each of the unit plate pieces may have loop portions extending or protruding from four sides of a rectangular plate body having a predetermined thickness, and the rectangular reticulate pad may be provided by coupling and fastening the loop portions to one another by the connecting loop members in a state in which the unit plate pieces are arranged such that loop portions of adjacent ones of the unit plate pieces face one another.

In addition, each of the connecting loop members may include a pair of loop members foldably coupled to each other by means of a hinge pin.

In addition, each of the fastening belt members may be configured such that an elastic band and one end of the elastic band are fixedly fastened to the loop portions of the unit plate piece by means of a clip-type fastener to define a fixed end, and a hook selectively hooked on to the loop portion of one of the plurality of unit plate pieces is connected to a free end of the elastic band by means of another clip-type fastener.

As described above, the finger guard according to the present disclosure is configured to be worn in the form of a protective armor to appropriately adjust fastening of the finger guard so as to be tailored to the thickness of a wearer's finger when the finger guard is worn for finger protection, thereby efficiently improve convenience in use and wearing comfort.

In addition, the finger guard according to the present disclosure can improve a degree of freedom in terms of finger motions and knuckle movements when the finger guard is worn for finger protection, thereby providing enhanced functionality and quality for efficiently performing an elaborate and precise work.

In addition, the finger guard according to the present disclosure has an increased fastening force applied on a finger by means of fastening means when the finger guard is worn for finger protection, thereby improving stability and wearing comfort.

BRIEF DESCRIPTION OF DRAWINGS

FIG. 1 is a schematic perspective view showing a finger guard according to the present disclosure.

FIG. 2 is a schematic perspective view showing a state in which the finger guard according to the present disclosure is worn.

FIG. 3 is a schematic exploded perspective view showing a unit plate piece of the finger guard according to the present disclosure.

FIG. 4 is a schematic exploded perspective view showing a connecting loop member for connecting unit plate pieces of the finger guard according to the present disclosure to each other.

FIG. 5 is a schematic exploded perspective view showing a fastening belt member of the finger guard according to the present disclosure.

DETAILED DESCRIPTION

Hereinafter, a finger guard according to the present disclosure will be described in detail with reference to the accompanying drawings. The following description and the accompanying drawings are provided for a better understanding of the technical configurations and operational states of the present disclosure, and what can be easily implemented by a person skilled in the art may be omitted.

FIG. 1 is a schematic perspective view showing a finger guard according to the present disclosure and FIG. 2 is a schematic perspective view showing a state in which the finger guard according to the present disclosure is worn.

Referring to FIGS. 1 and 2, the finger guard 100 according to the present disclosure includes a rectangular reticulate or netlike pad 110 networked in a movable manner such that a plurality of unit plate pieces 120 are connected to one another in four directions by a plurality of connecting loop members 130, and at least a pair of fastening belt members 140 provided to extend or protrude parallel with one side of the reticulate pad 110.

With the aforementioned configuration, the finger guard 100 according to the present disclosure is configured to be worn in the form of, for example, a protective armor, such that the reticulate pad 110 covers and wraps around the dorsal side (or the back) of a finger, upon which the finger guard is to be worn, and the respective fastening belt members 140 pass the volar side (or the ventral side) of the finger to then be connected to be hooked on to one of the unit plate pieces 120 in a state in which a portion of the volar side of the finger is opened and exposed in a length direction of the finger.9

FIG. 3 is a schematic exploded perspective view showing a unit plate piece of the finger guard according to the present disclosure, in which the unit plate piece is illustrated in an enlarged form for the purpose of clarity, compared to each of the unit plate pieces illustrated as an overall view in FIG. 1.

Referring to FIG. 3, the unit plate piece 120 has loop portions 122 extending or protruding from four sides of a rectangular plate body 121 having a predetermined thickness. Accordingly, the rectangular reticulate pad 110 can be provided by coupling and fastening the loop portions 122 to one another by means of the connecting loop members 130 in a state in which the unit plate pieces 120 are arranged such that loop portions 122 of adjacent ones of the unit plate pieces 120 face one another. With this configuration, the respective unit plate pieces 120 may be movably coupled to one another by the connecting loop members 130.

Meanwhile, in the finger guard 100 according to the present disclosure, the unit plate pieces 120 may be formed using a metal or resin molded body, like, for example, ornament accessories, such as earrings or necklaces, including a plurality of unit granulated beads connected to one another.

In the present disclosure, however, the material of the unit plate piece 120 is not limited to, for example, a metal or a resin. The unit plate piece 120 may be formed using molded bodies made of a variety of materials having given strength and hardness, such as, for example, small-sized molded bodies, e.g., wooden pieces.

FIG. 4 is a schematic exploded perspective view showing a connecting loop member for connecting unit plate pieces of the finger guard according to the present disclosure to each other, in which the connecting loop member is illustrated in an enlarged form for the purpose of clarity, compared to each of the connecting loop members illustrated as the overall view in FIG. 1.

Referring to FIG. 4, the connecting loop member 130 includes a pair of loop members 131 foldably coupled to each other by means of a hinge pin 132. Like the unit plate piece 120, the connecting loop member 130 may also be formed using a metal or resin molded body as a constituent of, for example, an ornament accessory.

FIG. 5 is a schematic exploded perspective view showing a fastening belt member of the finger guard according to the present disclosure in which the fastening belt member is illustrated in an enlarged form for the purpose of clarity, compared to each of the fastening belt members illustrated as the overall view in FIG. 1.

Referring to FIG. 5, the fastening belt member 140 in the form of, for example, a wrist watch strap, may be configured such that an elastic band 141 having a predetermined length and thickness and one end of the elastic band 141 are fixedly fastened to the loop portions 122 of the unit plate piece 120 by means of a clip-type fastener 142 to define a fixed end, and a hook 143 selectively hooked on to the loop portion 122 of one of the plurality of unit plate pieces 120 is connected to a free end of the elastic band 141 by means of another clip-type fastener 144.

With the aforementioned configuration, the finger guard 100 according to the present disclosure can be worn in the form of, for example, a protective armor, such that the reticulate pad 110 being in an extended state, as illustrated in FIG. 1, covers and wraps around the dorsal side of a finger, for example, an index finger or a middle finger, upon which the finger guard is to be worn, and the respective fastening belt members 140 pass the volar side of the finger to then be connected to be hooked on to one of the unit plate pieces 120 in a state in which a portion of the volar side of the finger is opened and exposed in a length direction of the finger. Here, because the lengthwise opened and exposed portion of the volar side of the finger may have variable widths according to the thickness of the wearer's finger, the finger guard 100 according to the present disclosure can be formed to have variable sizes easily adjusted to be tailored to the thickness of the wearer's finger.

In addition, because the respective unit plate pieces 120 are movably coupled to one another by the connecting loop members 130, the finger guard 100 according to the present disclosure can be worn in the form of, for example, a protective armor, the degree of freedom in terms of finger motions and knuckle movements can be improved so as to flexibly respond to a minute finger movement. Accordingly, the finger guard 100 according to the present disclosure can achieve enhanced functionality and quality for efficiently performing an elaborate and precise work when the finger guard 100 is worn for finger protection.

While the foregoing embodiment has been described to practice the finger guard of the present disclosure, it will be understood by those of ordinary skill in the art that various changes in forms and details may be made therein without departing from the spirit and scope of the present disclosure as defined by the following claims.

What is claimed is:

1. A finger guard comprising:

a pad having a rectangular reticulate pattern including a plurality of unit plate pieces and a plurality of connecting loop members, each said connecting loop member hingedly connecting two unit plate pieces of the plurality of unit plate pieces;

each said unit plate piece having a rectangular plate body and four loop portions, wherein the four loop portions include a first loop portion, a second loop portion, a third loop portion and a fourth loop portion, and wherein the rectangular plate body has a top surface, a bottom surface, and four side surfaces, and wherein the four side surfaces include a first side surface, a second side surface, a third side surface and a fourth side surface, and wherein the first loop portion extends from the first side surface of the rectangular plate body, the second loop portion extends from the second side surface of the rectangular plate body, the third loop portion extends from the third side surface of the rectangular plate body, and the fourth loop portion extends from the fourth side surface of the rectangular plate body, each said connecting loop member having a first loop member that hingedly engages into one of the four loop portions of a first one of the plurality of unit plate pieces and having a second a loop member that hingedly engages into one of the four loop portions of a second one of the plurality of unit plate pieces; and a fastening belt member having a first end rotatably fastened to the pad and a second end that is configured to be detachably coupled to the pad.

2. The finger guard of claim 1, wherein the first and second loop members of each said connecting loop member are coupled to each other by a hinge pin.

3. The finger guard of claim 1, wherein the fastening belt member includes an elastic band that extends between the first and second ends of the fastening belt member.

4. The finger guard of claim 1, wherein the first end of the fastening belt member includes a clip-type fastener that is rotatably fastened to one of the four loop portions of a unit plate piece and wherein the second end of the fastening belt member includes a hinge pin that is configured to detachably engage into one of the four loop portions of a unit plate piece.

* * * * *